US009532607B2

(12) United States Patent
Lambertz

(10) Patent No.: US 9,532,607 B2
(45) Date of Patent: Jan. 3, 2017

(54) SOCK

(75) Inventor: Bodo W. Lambertz, Pfaffikon (CH)

(73) Assignee: X-Technology Swiss GmbH, Wollerau (CH)

( * ) Notice: Subject to any disclaimer, the term of this patent is extended or adjusted under 35 U.S.C. 154(b) by 359 days.

(21) Appl. No.: 14/240,095

(22) PCT Filed: Aug. 25, 2012

(86) PCT No.: PCT/EP2012/066561
§ 371 (c)(1),
(2), (4) Date: Jun. 16, 2014

(87) PCT Pub. No.: WO2013/026935
PCT Pub. Date: Feb. 28, 2013

(65) Prior Publication Data

US 2014/0289934 A1 Oct. 2, 2014

(51) Int. Cl.
*A41B 11/02* (2006.01)
*A41B 11/00* (2006.01)
*A41D 13/06* (2006.01)

(52) U.S. Cl.
CPC ..... *A41B 11/02* (2013.01); *A41B 11/003* (2013.01); *A41D 13/06* (2013.01)

(58) Field of Classification Search
CPC ..... A41B 11/00; A41B 11/003; A41B 11/005; A41B 11/007; A41B 11/02; A41B 11/14; A43B 17/00; A43B 17/003; A43B 17/006; A61F 5/0111; A61F 5/0127
USPC ..... 2/239, 241; 36/71
See application file for complete search history.

(56) References Cited

U.S. PATENT DOCUMENTS 4,651,354 A * 3/1987 Petrey ..... A41B 11/004 2/239
5,708,985 A * 1/1998 Ogden ..... A41B 11/02 2/239
D627,147 S * 11/2010 Lambertz ..... D2/994
8,959,796 B2 * 2/2015 Lazaris ..... A43B 3/102 36/11.5
2006/0130217 A1 * 6/2006 Lambertz ..... A41B 11/00 2/239
2006/0143801 A1 * 7/2006 Lambertz ..... A41B 11/00 2/239
2006/0195971 A1 * 9/2006 Lambertz ..... A41B 11/00 2/239
2007/0094892 A1 * 5/2007 Craig ..... A41B 11/02 36/10
2008/0189829 A1 * 8/2008 Fusco ..... A61F 5/30 2/239
2009/0013450 A1 * 1/2009 Lambertz ..... A41B 11/003 2/239
2010/0088804 A1 * 4/2010 Crosby ..... A41B 11/004 2/239
2010/0269244 A1 * 10/2010 Nurse ..... A41B 11/10 2/239
2011/0277218 A1 * 11/2011 Padilla ..... A41B 11/02 2/239

(Continued)

*Primary Examiner* — Amy Vanatta
(74) *Attorney, Agent, or Firm* — Olson & Cepuritis, Ltd.

(57) ABSTRACT

A sock, in particular, a sports sock, comprising a sole region (10), which has a toe region (1), a ball region (2), and a heel region (3). The sole region (10) is provided with a heel guide pad (4) and a ball guide pad (5), which lie substantially parallel to a longitudinal roll line (6) of the foot of the wearer of the sock.

19 Claims, 3 Drawing Sheets

(56) References Cited

U.S. PATENT DOCUMENTS

| | | | | |
|---|---|---|---|---|
| 2014/0230131 | A1* | 8/2014 | Alston | A41B 11/007 2/239 |
| 2016/0081836 | A1* | 3/2016 | Sawle | A41B 11/007 602/28 |

* cited by examiner

SOCK

CROSS-REFERENCE TO RELATED APPLICATIONS

This application is a 371 U.S. National Stage filing of PCT/EP2012/066561, filed Aug. 25, 2012, which claims priority to German Application No. 20 2011 051 102.3 filed Aug. 25, 2011, which is incorporated herein by reference.

FEDERALLY SPONSORED RESEARCH OR DEVELOPMENT

Not Applicable.

BACKGROUND OF THE INVENTION

Field of the Invention

The invention relates to a sock, in particular a sports sock, comprising a sole region which has a toe region, a ball region and a heel region.

The term sock here stands for all types of legwear, including also, for example, stockings, tights, foot wraps and the like.

In sports activities in particular, socks today not only serve the function of reducing friction between the foot and the shoe, they also support the foot in its natural rolling movement. In a running and jumping movement, an increased load is applied to the foot, as a result of which the foot buckles to dampen the impact. In this so-called pronation, the foot with its outer sole marginal region rests against the base support and it shifts the load subsequently slightly toward the foot inner side, so that the longitudinal arch of the foot can cave in and thus absorb part of the impact.

Pronation depends on the particular configuration of the foot. Here, a distinction must be made between different foot types, namely the normal foot, the contracted foot, and the flat foot. The normal foot has a foot arch optimally shaped for the rolling movement. During walking or running, it first contacts the ground with the outer side of the back of the foot, then it rolls inward, in order to absorb and dampen the impact on the ground. This is referred to as natural pronation. Contracted feet, on the other hand, do not buckle inward in the landing phase, and they leave a footprint primarily in the front and back foot regions. This is referred to as underpronation. As a result, the natural protection of the foot against impacts is strongly reduced. Flat feet, on the other hand, have a very low foot arch and they leave a complete footprint, because they buckle very strongly toward the inner side after the setting down phase. This movement is referred to as overpronation.

Both in underpronation and in overpronation, insufficient damping of the impact energy generated during walking or running occurs. Consequently, the foot—and as a result the rest of the locomotion apparatus of humans—is exposed to particularly heavy loads.

Description of Related Art

In order to protect the tendons and the ligaments, it is therefore known to use socks that support the natural roll movement of the foot and reduce the extent of underpronation or overpronation. DE 10 2007 024 758 A1 discloses such a sock. The sole region of the sock is here provided with a pronation support, which is arranged in the region of the longitudinal arch of the sole region. The pronation support is formed in the shape of a sickle and it has substantially the length of the longitudinal arch and a width that is two to four times smaller.

Moreover, in the sole region, a front and a rear damping region are provided, which dampen the impact of the ball region and of the heel region. Here, the disadvantage of this sole region, which has been subdivided into several regions, is the low wearer comfort, resulting from the slipping of the sock on the foot of the wearer. As a result of several independently acting functional regions, the overall hold is insufficient and as a result the control of the roll of the foot by the sock is insufficient, so that the foot does not roll along the roll line.

In addition, in the prior art, other variants exist that provide a one-part design of the functional regions. For example, DE 10 2008 020 993 B4 describes a sock in which the entire sole region, i.e., over its entire length, has a design with structuring as a function of a roll line. Although this ensures a secure hold of the foot during the roll movement, an unpleasantly rigid wearing sensation for the wearer is generated, due to the firm guidance of the sock. In addition, at the buckling places of the structure, material is thrown over, which can leave painful pressure sites on the foot sole.

BRIEF SUMMARY OF THE INVENTION

Therefore, the problem of the present invention is to provide a sock having a high wearer comfort, which prevents the above-mentioned disadvantages of the prior art, and which supports and guides the natural inward rotation of the foot without buckling inward.

This problem is solved by the invention in that the sole region has a heel guide pad and a ball guide pad, which are arranged substantially parallel to a roll line of a foot. As a result of this design according to the invention, the foot is guided simultaneously at different sites of the sole region parallel to the roll line. The ball guide pad here ensures the support and guidance of the front foot region, while the heel guide pad at the same time assumes the function of supporting and guiding the foot region near the heel. Overall, as a result of the respective one-part design of the guide pads arranged parallel to one another, a stable guidance of the foot in the desired roll-off direction occurs. The conceptual delimitation between the ball region and the heel region of the foot is here determined substantially by the natural shape of the foot, which delimits the ball region or the heel region by the longitudinal arch of the foot.

The guide pads can, as desired, consist of the same material as the sock itself or of another material. Here, the regions formed by the guide pads can be woven from another woven structure, so that the material overall becomes denser and stronger, and thus forms a material reinforcement. Alternatively, it is also possible, however, to apply separate textile layers as guide pads onto the sole region.

The heel guide pad is advantageously formed over the entire heel region. As a result, the heel rests completely on the guide pad, so that a slipping of the sock and the resulting painful pressure sites caused by stepping on the marginal region of the guide pad are prevented.

Advantageously, the heel guide pad is formed from the heel region to the ball region delimitation pointing in the direction of the heel region. Thus, the heel guide pad extends substantially over the entire heel region, to the side along the delimitation of the longitudinal arch of the foot, up to the beginning of the ball region. The resulting movement corresponds substantially to the roll line of the foot, so that the heel guide pad optimally guides the foot in its rolling movement.

The ball guide pad is formed substantially by a ball region delimitation pointing in the direction of the heel region, in the region of a sole marginal region up to the toe region in the region of a big toe. As a result of this configuration, the ball guide pad also forms a shape similar to the course of the roll line of the foot. The ball guide pad extends thus from the outer sole delimitation approximately in the region of the delimitation of the ball of the foot up to the opposite sole margin, approximately in the region of the big toe.

Due to the combination of the resulting shaped ball guide pad and heel guide pad, the foot is guided in two different regions of the sole—ball and heel—into the correct roll direction. Therefore, the movement starts not only from one region of the foot, but from two identically acting regions. As a result, the movement of the foot is guided in a very stable manner, which is nevertheless highly comfortable for the wearer.

Moreover, the roll movement is supported in that the heel guide pad and the ball guide pad are substantially in the shape of an arc. Since the roll line itself also extends in the shape of an arc over the sole region, the natural course is imitated by the shape of the guide pad.

In a particularly advantageous manner, the heel guide pad is arranged in a form fitting manner on the longitudinal arch of the sole region. As a result, the foot rests on the heel guide pad, exactly at the place where the main load region is located during the roll movement. As a result, a region with stabilizing properties in the marginal region of the longitudinal arch is created for the foot, which prevents excessive inward buckling of the foot, i.e., in the direction of the longitudinal arch.

An embodiment variant of the invention provides that the heel guide pad comprises perforations in the region of the longitudinal arch. These perforations increase the mobility of the heel guide pad. In the case of a compression of the sole region, there is thus no raising of the surface of the guide pad, which could press in an unpleasant manner against the foot sole and in the worst case cause pressure sites or blisters. The perforations function thus as expansion joints which increase the comfort of wearing the sock in different load stages of the roll movement. At the same time, in the uncompressed state of the sole region, the perforations act as air channels which allow air circulation between the shoe and the foot. This too contributes to increasing the wearing comfort. Overall, a heel guide pad having three perforations has been found to be particularly advantageous. This offers an optimal combination of stability and at the same time mobility and air permeability.

An alternative embodiment variant of the invention provides that the sole region in the region of the longitudinal arch and/or in the region of the perforations has material reinforcements. According to this variant, a reinforcement is introduced in the sole region of the longitudinal arch, which additionally stabilizes this region and prevents inward buckling of the foot. This material reinforcement can consist of a separate textile layer or a web variant having a higher material density. Within the perforations, a reinforcement can also be introduced. This is then used as a stabilizing element between the elements of the heel guide pad, which are arranged so they can move next to one another. At the same time, the perforations of the material reinforcement are filled, so that, according to this variant, portions of the skin cannot become pinched.

Particularly advantageously, the material reinforcements arranged in the region of the perforations can be formed in a ray pattern from the delimitation of the longitudinal arch to an opposite sole marginal region. Since, according to this embodiment, the outer sole marginal region is connected to the opposite sole marginal region, namely the longitudinal arch, a particularly good fit of the sock to the foot is achieved. This effect can be promoted by additionally giving the material reinforcement pointing outwards in a ray pattern resilient properties, which stretch the sole region of the sock over the foot of the wearer.

In addition, the sock according to the invention can have material reinforcements in the toe region. Said reinforcements protect, on the one hand, the toes from excessive friction against the footwear, and, on the other hand, the sock from excessive wear.

In the sense of the invention, it is advantageous for the material reinforcements of the toe region and/or of the heel guide pad and/or of the ball guide pad to have greater stiffness than the material reinforcements in the region of the longitudinal arch and in the region of the perforations. As a result, on the one hand, the required stability and the guiding capacity of the guide pad are ensured, and, on the other hand, the flexibility of the guide pad and the comfort of wearing the entire sock are ensured at the same time.

BRIEF DESCRIPTION OF THE DRAWINGS

The invention is explained in further detail below in reference to the drawing. The figures show in detail.

DESCRIPTION OF THE INVENTION

Figure 1:
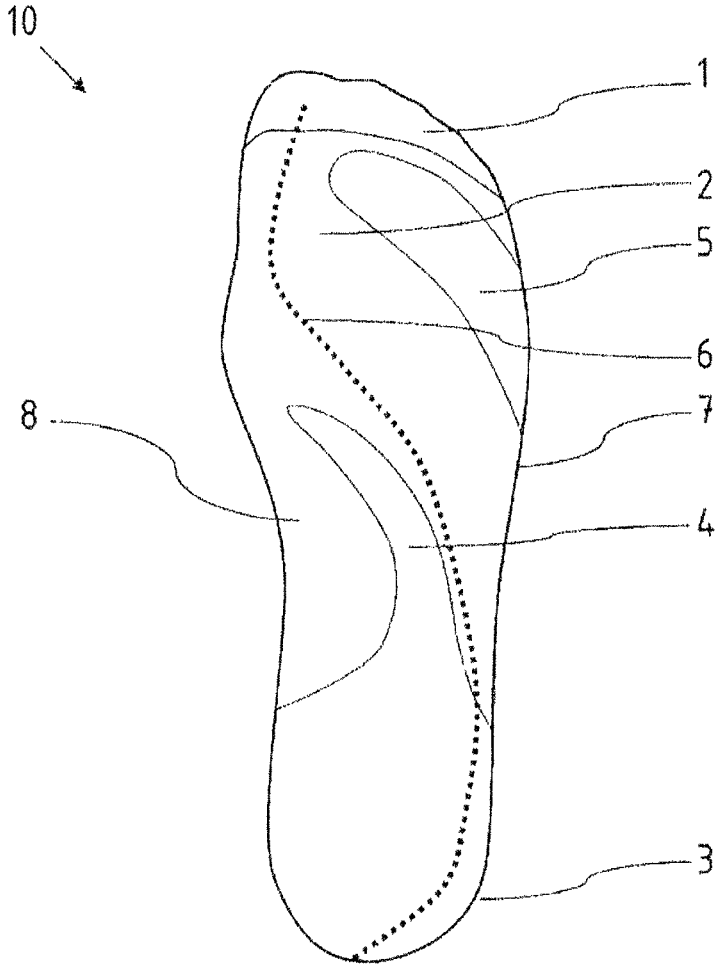
FIG. 1 shows a sole region of a sock having a heel guide pad and a ball guide pad.

The sock variant represented in FIG. 1 has a sole region 10 which has a toe region 1, a ball region 2 and a heel region 3. A heel guide pad 4 is introduced in the heel region 3. Similarly, the ball region 2 has a ball guide pad 5. The heel guide pad 4 and the ball guide pad 5 are arranged parallel to the natural roll line 6 of the foot, wherein the ball guide pad 5 extends from the outer sole marginal region 7 at the delimitation of the ball region 2 to the toe region 1 in the region of the big toe. The heel guide pad 4 is in addition formed in the shape of an arc, so that it extends partially along the curved delimitation of the foot arch 8.

The heel guide pad 4, as well as the ball guide pad 5, can be made of one or more materials that have increased stiffness or strength in comparison to the other regions of the sole region 10. Such an increased stiffness/strength can be achieved by denser web types and also by applying separate textile parts to the sole region 10. The shape of the heel guide pad 4 and of the ball guide pad 5 resembles that of the middle partial region of the roll line 6 of the foot. As a result, the foot is guided in its roll movement in the direction of the roll line 6. Since the heel guide pad 4 takes up the entire surface of the heel, the latter rests on a stable base support without interfering delimitation edges. The arc-shaped extension along the longitudinal arch 8 of the foot guides the foot from the position at the time of stepping on the ground into a position where the foot buckles inward slightly. The ball guide pad 5 supports this movement by its position in the ball region 2. Thus, the movement occurs not only separately at the heel region 3, but simultaneously also at the ball region 2.

Figure 2:
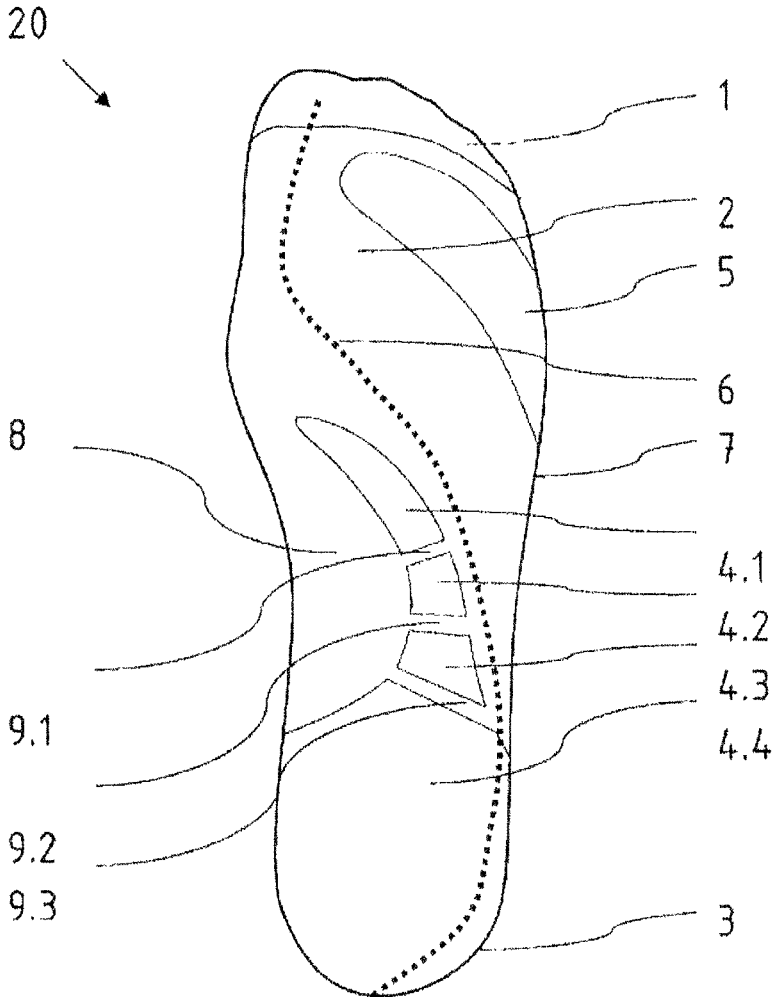
FIG. 2 shows a sole region of a sock having a heel guide pad which has perforations, and a ball guide pad.

The variant of a sock according to the invention represented in FIG. 2 again shows a sole region 20 having a heel guide pad 4 and a ball guide pad 5. Compared to FIG. 1, the heel guide pad 4 is provided here with perforations 9.1, 9.2, 9.3 which divide the guide pad 4 into individual segments 4.1, 4.2, 4.3, 4.4. The perforations in this embodiment variant are used as air channels extending transversely to the stepping direction, which ensure, on the one hand, air circulation between the shoe and the foot, and on the other hand, the mobility of the heel guide pad 4. For example, in the case of a compression of the foot, the perforations 9.1, 9.2, 9.3 assume the function of expansion joints which prevent the material from being thrown over and thus also possible pressure sites or injuries on the foot. The material within the perforations 9.1, 9.2, 9.3 can be the same material as that of the heel guide pad 4 or also of the rest of the sole region. Here, the represented functions can be achieved by a different web thickness of the sock material. Alternatively, however, different materials can also be used, which have a higher stiffness and/or thickness in the region of the heel guide pad 4 than the material in the perforations 9.1, 9.2, 9.3.

Figure 3:
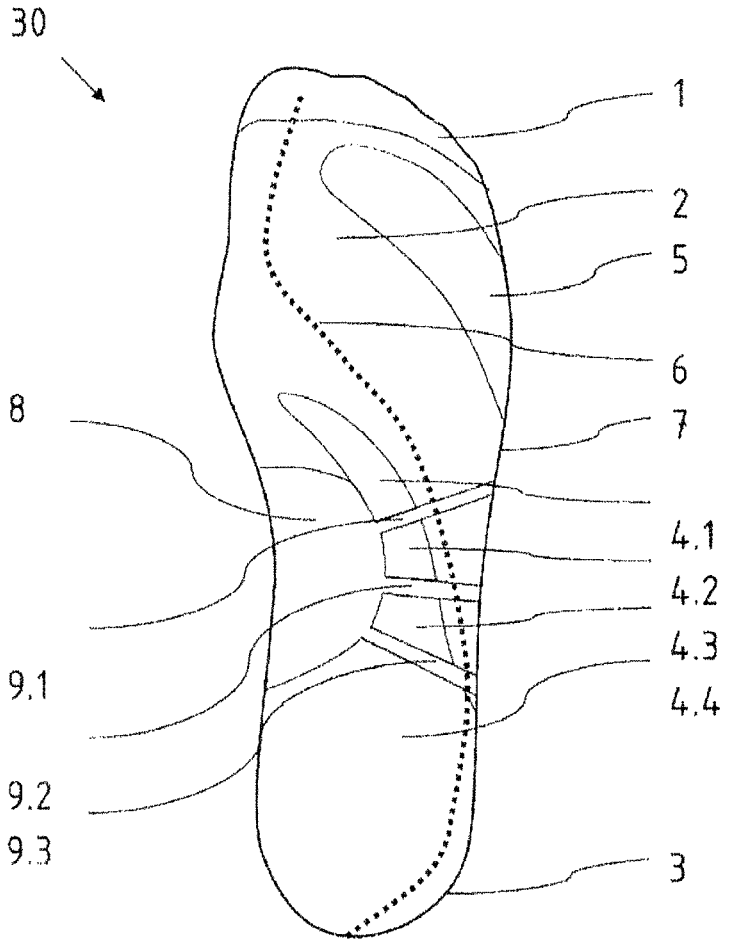
FIG. 3 shows a sole region which has material reinforcements in the region of the longitudinal arch and in the region of perforations of the heel guide pad.

The embodiment variant according to FIG. 3 also has a sole region 30 having a heel guide pad 4 which consists of individual segments 4.1, 4.2, 4.3, 4.4. In the region of the longitudinal arch 8, a substantially semi-circular material reinforcement is introduced, which abuts in a form fitting manner against the inner delimitation of the heel guide pad 4, and extends from there in a ray pattern through the perforations 9.1, 9.2, 9.3 up to the opposite sole marginal region 7. The material reinforcements in the region of the longitudinal arch 8 as well as in the region of the continuations in a ray pattern can have resilient properties, so that the sock in the region of the longitudinal arch 8 and of the heel guide pad 4 is applied firmly against the foot. As a result, the heel guide pad is held optimally in a position corresponding to the roll line 6.

The invention claimed is:

1. A sock comprising a sole region (10) which has a toe region (1), a ball region (2) a heel region (3), and a longitudinal arch region (8) wherein the sole region (10) has a heel guide pad (4) and a ball guide pad (5) wherein at least an upper portion of the heel guide pad (4) and a lower portion of the ball guide pad (5) are formed in the shape of arcs and arranged substantially parallel to a roll line (6) of a foot, the roll line being defined as a line which begins at the back portion of the heel region (3) and extends along the outer side of the rear of the heel region substantially parallel to an outersole marginal region (7) and then substantially transverse to the longitudinal arch region (8) through the ball region (2) to a big toe portion of the toe region (1) and terminates substantially parallel to the big toe wherein the heel guide pad (4) and the ball guide pad (5) are arranged to guide the foot in its rolling movement along the roll line and wherein the heel guide pad further has perforations (9) in the region of the longitudinal arch (8) with material reinforcements arranged in the region of the perforations (9) and formed through the perforations (9) in a ray pattern from an inner delimitation of the longitudinal arch (8) up to an opposite sole marginal region (7).

2. A sock according to claim 1, wherein the heel guide pad (4) is formed over the entire heel region (3).

3. A sock according to claim 1, wherein the heel guide pad (4) extends from the heel region (3) up to a delimitation of the ball region (2) which points in the direction of the heel region (3).

4. A sock according to claim 1, wherein the ball guide pad (5) is formed substantially by a delimitation of the ball region (2) which points in the direction of the heel region (3), in the region of a sole marginal region (7) up to the toe region (1) in the region of a big toe.

5. A sock according to claim 1, wherein the heel guide pad (4) is arranged in a form fitting manner along the longitudinal arch (8) of the sole region (10).

6. A sock according to claim 1, wherein the heel guide pad (4) has three perforations (9).

7. A sock according to claim 6, wherein the sole region (10) has material reinforcements in the region of the longitudinal arch (8) and/or the perforations (9).

8. A sock according to claim 7, wherein the toe region (1) has material reinforcements.

9. A sock according to claim 7, wherein the heel guide pad (4) and the ball guide pad (5) have material reinforcements.

10. A sock according to claim 9, wherein the material reinforcements are web reinforcements.

11. A sock according to claim 10, wherein a material reinforcement of the toe region (1) and/or of the heel guide pad (4) and/or of the ball guide pad (5) have a greater stiffness than the material reinforcements in the region of the longitudinal arch (8) and in the region of the perforations (9).

12. A sock according to claim 2, wherein the heel guide pad (4) extends from the heel region (3) up to a delimitation of the ball region (2) which points in the direction of the heel region (3).

13. A sock according to claim 1, wherein the sole region (10) has material reinforcements in the region of the longitudinal arch (8) and/or the perforations (9).

14. A sock according to claim 1, wherein the toe region (1) has material reinforcements.

15. A sock according to claim 1, wherein the heel guide pad (4) and the ball guide pad (5) have material reinforcements.

16. A sock according to claim 1, wherein the material reinforcements are web reinforcements.

17. A sock according to claim 6, wherein the material reinforcements are web reinforcements.

18. A sock comprising a sole region (10) which has a toe region (1), a ball region (2) and a heel region (3), wherein the sole region (10) has a heel guide pad (4) and a ball guide pad (5), wherein at least an upper portion of the heel guide pad (4) and a lower portion of the ball guide pad (5) are formed in the shape of arcs and arranged substantially parallel to a roll line (6) of a foot, the roll line being defined as a line which begins at the back portion of the heel region (3) and extends along the outer side of the rear of the heel region substantially parallel to an outersole marginal region (7) and then substantially transverse to a longitudinal arch region (8) through the ball region (2) to a big toe portion of the toe region (1) and terminates substantially parallel to the big toe wherein the heel guide pad (4) and the ball guide pad (5) are arranged to guide the foot in its rolling movement along the roll line and wherein the heel guide pad (4) extends partially along a curved delimitation of a foot arch (8), the ball guide pad (5) extends from an outer sole marginal region (7) at a delimitation of the ball region (2) to the toe region (1) in the region of a big toe, the heel guide pad (4) having perforations (9) in the region of the longitudinal arch (8), which divide the heel guide pad (4) into individual segments arranged in the region of the perforations (9), the perforations (9) extending from a delimitation of the longitudinal arch (8) to an opposite sole marginal region (7), with material reinforcements arranged in the region of the perforations (9) in a ray pattern from an inner delineation of the longitudinal arch (8) to the opposite marginal region (7), and the heel guide pad (4) being formed over the entire heel region (3).

19. A sock according to claim 18, wherein the toe region (1) and/or the heel guide pad (4) and/or the ball guide pad (5) have material reinforcements having greater stiffness than the material reinforcements in the region of the longitudinal arch (8) and in the region of the perforations (9).

* * * * *